US006573464B2

(12) United States Patent
Yen

(10) Patent No.: US 6,573,464 B2
(45) Date of Patent: Jun. 3, 2003

(54) INPUT DEVICE WITH A FULCRUM INSTALLED IN THE MIDDLE

(75) Inventor: Hong-Che Yen, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 09/851,583

(22) Filed: May 10, 2001

(65) Prior Publication Data

US 2002/0066653 A1 Jun. 6, 2002

(30) Foreign Application Priority Data

Dec. 6, 2000 (TW) ..... 89125942 A

(51) Int. Cl.[7] ..... H01H 19/02
(52) U.S. Cl. ..... 200/6 A; 200/6 R
(58) Field of Search ..... 200/6 R, 6 A, 200/329, 339, 553

(56) References Cited

U.S. PATENT DOCUMENTS 5,140,313 A * 8/1992 Wen ..... 340/709
6,084,189 A * 7/2000 Menche et al. ..... 200/315
6,225,579 B1 * 5/2001 Ritter et al. ..... 200/6 A

* cited by examiner

*Primary Examiner*—Elvin Enad
*Assistant Examiner*—Lisa Klaus
(74) *Attorney, Agent, or Firm*—Winston Hsu

(57) ABSTRACT

An input device, that includes a casing having at least an opening, a supporting base set on the casing, a base plate set within the casing, at least one pressure sensor set on the base plate, and an actuator movably set on the supporting base. Wherein the actuator is at least a touching point set within the opening and above the pressure sensor, so when a user presses the actuator and moves the touching point downwards, the touching point touches the pressure sensor to enable the pressure sensor to produce a corresponding sensing signal.

13 Claims, 8 Drawing Sheets

INPUT DEVICE WITH A FULCRUM INSTALLED IN THE MIDDLE

BACKGROUND OF THE INVENTION

1. Field of the Invention

The present invention relates to an input device, and more particularly, to an input device with a fulcrum installed in the middle.

2. Description of the Prior Art

Please refer to FIG. 1 and FIG. 2. FIG. 1 is an exploded diagram of an input device, and FIG. 2 is a sectional view of an input device according to the prior art. The input device 10 is set on the back plane 18, a cylinder actuator 12 that has a top surface 32 that interfaces with a user. Moreover, the input device 10 further comprises a protuberance 28 in a side and a cylinder pillar 20 at a bottom. A supporting wall 14 fixed on the back plane 18 encloses the actuator 12, the supporting wall 14 comprises a slit 30 in accordance with the protuberance 28 for keeping in position the actuator 12. An elastic component 17 with a circular hole 22 in the center is located under the actuator 12, with the elastic component 17 further comprising four actuating pillars 16. The cylinder pillar 20 of the actuator 12 is slidably disposed in a groove 24 of the back plane 18. Furthermore, four pressure sensors 26 located under the four actuating pillars 16 of the back plane 18 measure pressure.

Please refer to FIG. 3 of a diagram of the input device 10 depressed by a user according to the prior art. When the user presses an upper surface 32 of the actuator 12, the actuator 12 heels by a groove 24 set on the back plane 18 as a fulcrum. As shown is FIG. 3, the actuator 12 inclines left to the figure and represses the actuating pillars 16 of the elastic component 17 to depress the sensor 26 set on the back plane 18, the sensor 26 transforms the depressing pressure into a sensing signal. After that time, a whole process of sensing is completed.

A defect of the input device 10 according to the prior art is that the groove 24 serves as a fulcrum for an operation of the actuator 12. The actuator 12 and the elastic component 17 of the prior input device 10 are both set above the fulcrum of the groove 24, so that a distance between the upper surface 32 of the input device 10 and the groove 24 needs to lengthen to locate the elastic component 17. Specifically, it not only needs a large displacement to move the actuator 12 for the user, but also needs more space to move the actuator 12. To allow for a movable space for the actuator 12, the input device 10 needs to be rigged around by a supporting wall 14. The result being more space needed for the whole input device 10.

Furthermore, the elastic component 17 provided for actuating the sensor 26 and supporting the actuator 12, has to be set up so that the actuator 12 has an elastic force restoring to an origin after the user used. Since the elastic component 17 is almost pure rubber, it has a high elasticity. The elastic component 17 can not provide an effective elastic function, and in addition, deformation of the actuating pillar 16 results in it not matching correctly with the sensor 26, so leading the input device 10 to fail.

SUMMARY OF THE INVENTION

It is therefore a primary objective of the present invention to provide an input device having characteristics of being cleverly designed and firm with a fulcrum installed in the middle.

In a preferred embodiment, the present invention includes an input device, the input device comprising:

a casing having at least an opening, a supporting base set on the casing, a base plate set within the casing, at least a pressure sensor set on the base plate, and an actuator movably set on the supporting base. Wherein the actuator comprises at least a touching point set within the opening and above the pressure sensor, so when a user presses the actuator and moves the touching point downwards, the touching point touches the pressure sensor to enable the pressure sensor to produce a corresponding sensing signal.

It is an advantage of the present invention that it provides an input device with a fulcrum at the actuator.

These and other objectives and the advantages of the present invention will no doubt become obvious to those of ordinary skill in the art after having read the following detailed description of the preferred embodiment, which is illustrated in the various figures and drawings.

DETAILED DESCRIPTION OF THE PREFERRED EMBODIMENT

Figure 1:
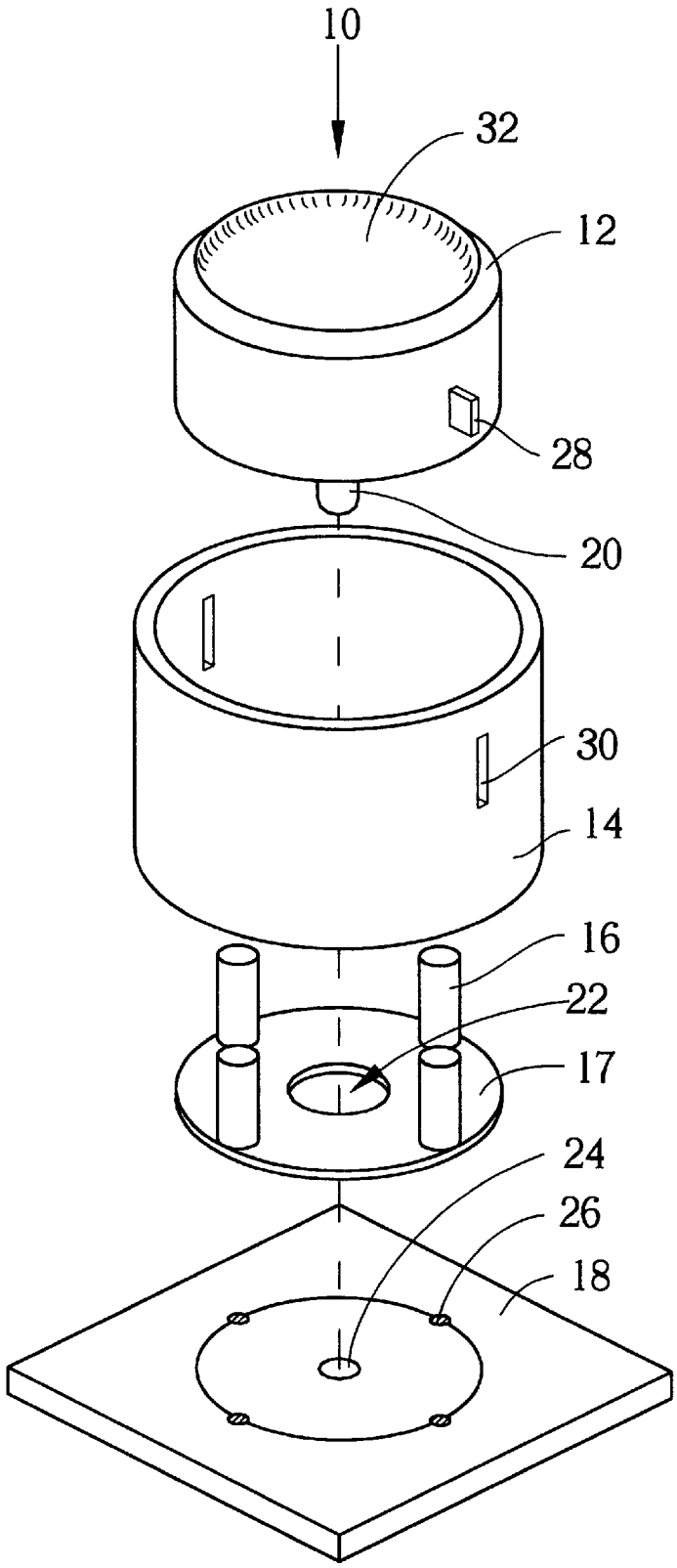
Fig. 1 Prior art
FIG. 1 is an exploded diagram of an input device according to the prior art.
Figure 2:
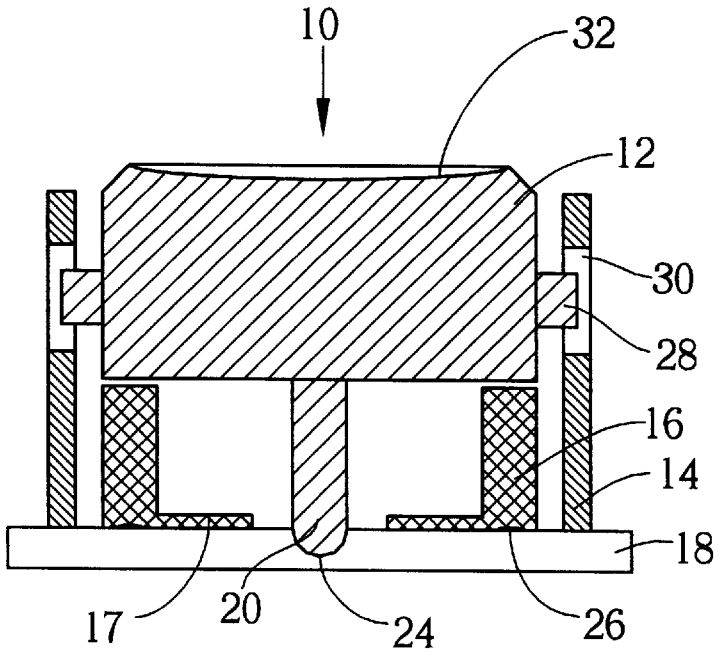
Fig. 2 Prior art
FIG. 2 is a section view of an input device according to the prior art.
Figure 3:
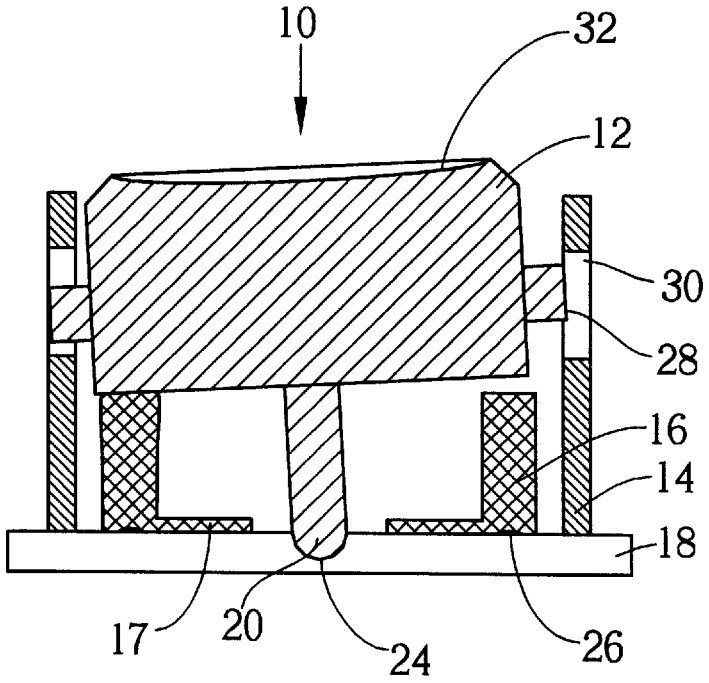
Fig. 3 Prior art
FIG. 3 is a diagram of an input device depressed by a user according to the prior art.
Figure 4:
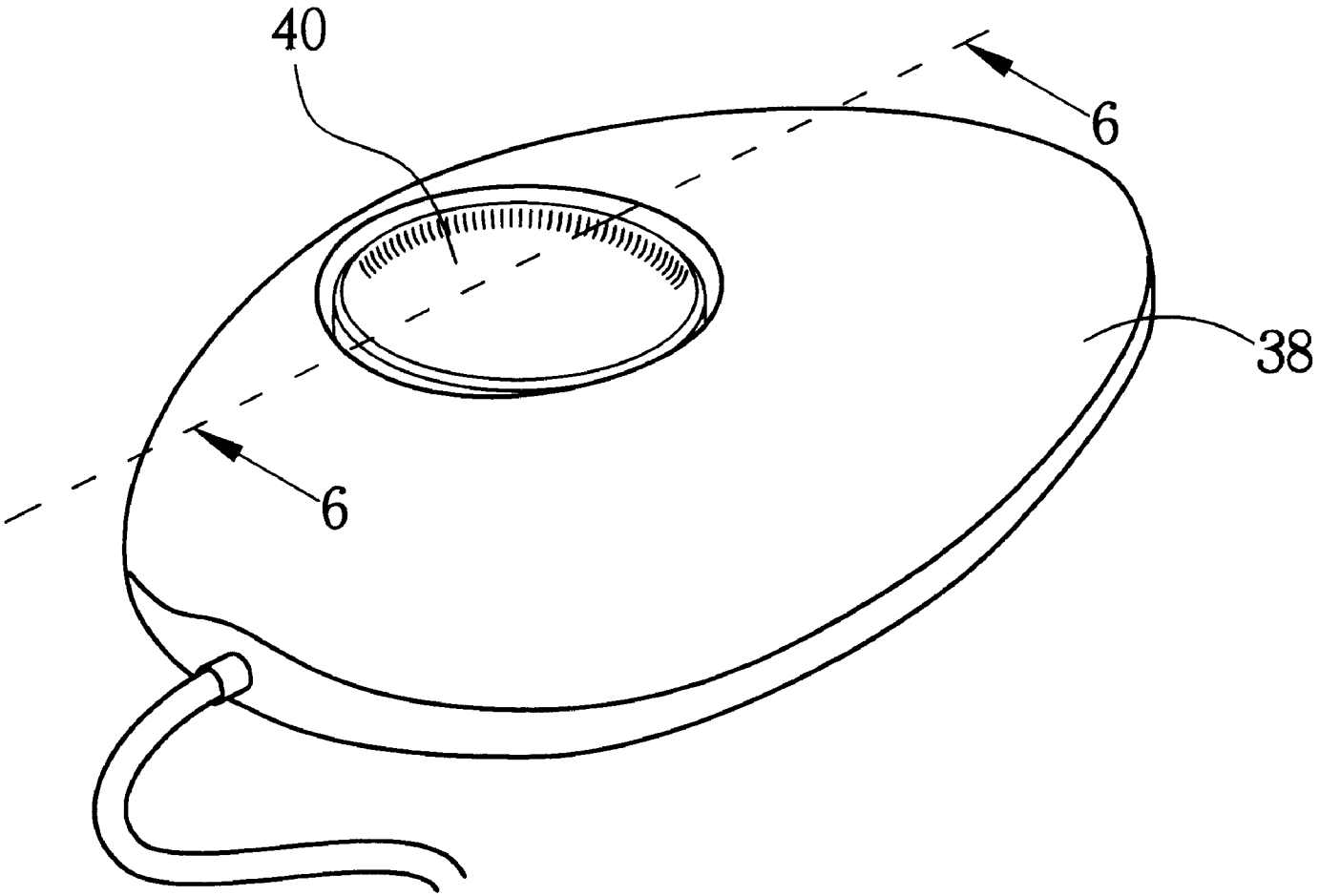
FIG. 4 is a perspective view of a present invention input device used in a mouse.

Please refer to FIG. 4 of a perspective view of a present invention input device 40 used in a mouse 38. The mouse 38 is convenient for a user to control an input device 40 of this invention.

Figure 5:
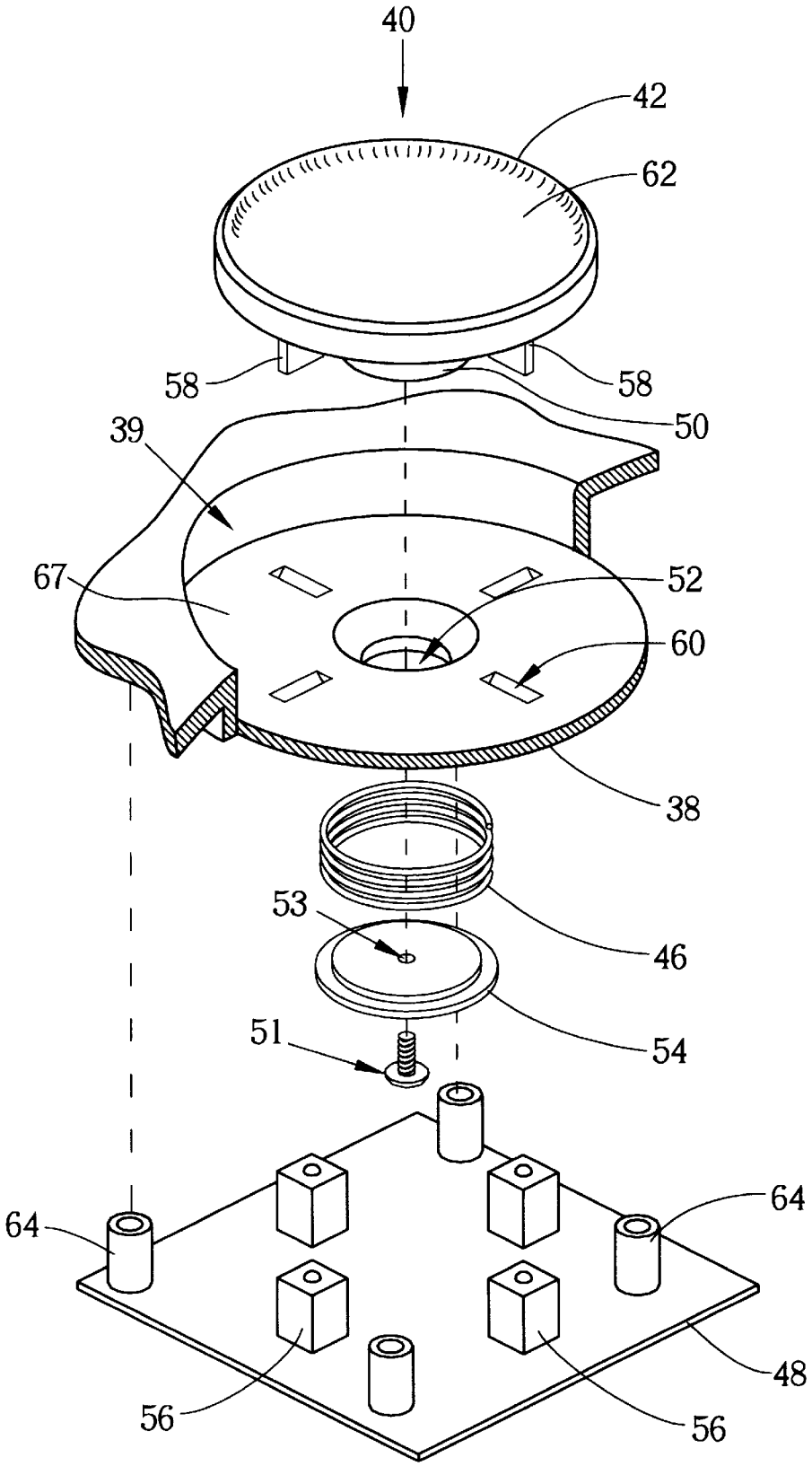
FIG. 5 is an exploded diagram of the present invention input device.
Figure 6:
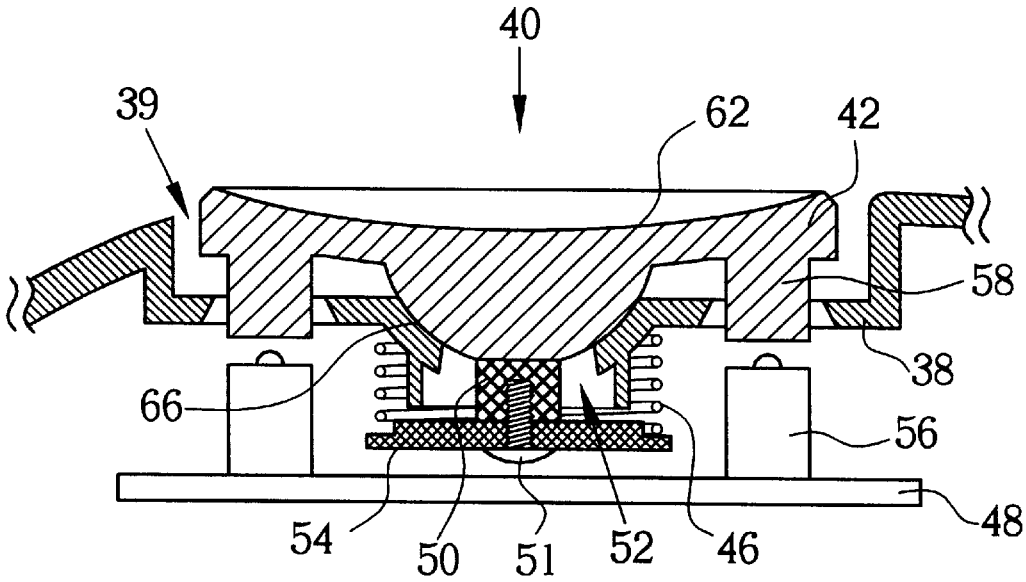
FIG. 6 is a section view along 6—6 of the present invention input device.

Please refer to FIG. 5 and FIG. 6. FIG. 5 is an exploded diagram of the present invention input device, and FIG. 6 is a section view along 6—6 of the present invention input device. For showing the input device 40 of this invention clearly, FIG. 5 or FIG. 6 only show a portion of a casing 38. In order to cooperate with the input device 40, the casing comprises a groove 39 to have a capacity of the input device 40. The input device 40 of this invention is set on the casing 38, and the input device 40 comprises a back plane 48. There are four switches 56 set on the back plane 48 that are used to measure pressure and transfer the pressure to a sensing signal. The back plane 48 is fixed within the casing 38 by four fixing pillars 64. The movable portion of the input device 40 is an actuator 42, an upper surface 62 of the actuator 42 is a touching surface of a user, a lower surface of the actuator 42 comprises tour touching points 58, an arc surface 66 in the center (please refer to FIG. 6), and a bar 50 with a top end fixed at a bottom center of the actuator 42. The casing 38 comprises a supporting base 67 monolithically formed with the casing 38 corresponding to the concave surface 66. The center of the supporting base 67 comprises an open hole 52 that passes through the casing 38. Furthermore, the casing 38 further comprises four openings 60 corresponding to the touching points 58. The bar 50 of the actuator 42 passes through the open hole 52, a base 54 fixed at a lower end of the bar 50, and an elastic component 46 is clamped between the base 54 and an edge of the open hole 52. A screw 51 is used to fix the base 54 to the lower end of the bar 50 by passing through a screw opening 53 set on the base 54. In addition, the touching points 58 also passes through the openings 60 of the casing 38 and elongate into the inner of the casing 38. Four switches 56 on the back plane 48 correspond to the four touching points 58.

Figure 7:
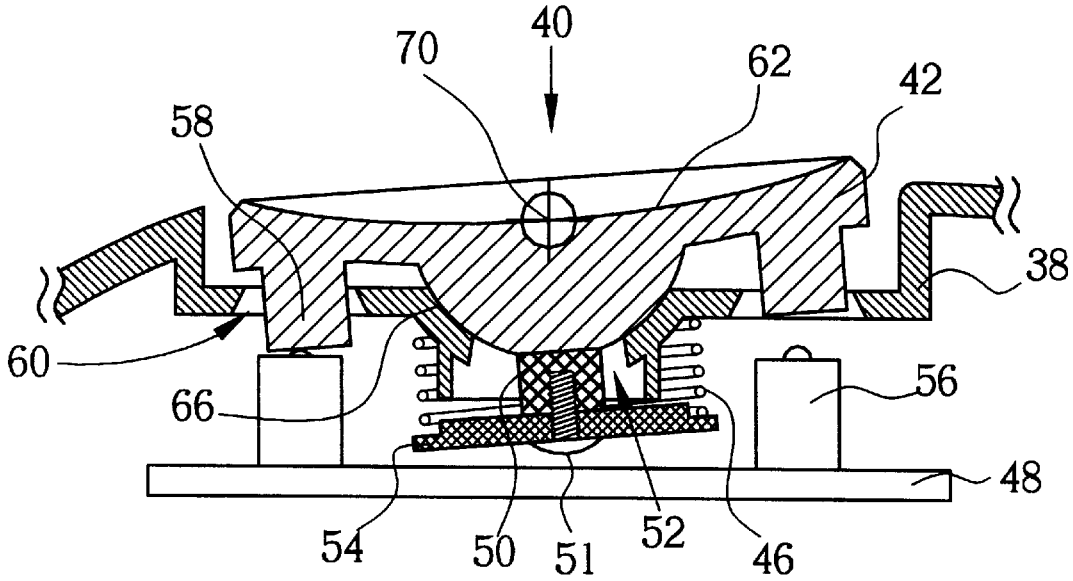
FIG. 7 is a diagram of the present invention input device depressed by a user.

As for an operating principle of the present invention input device 40, please refer to FIG. 7 of a diagram of the present invention input device 40 depressed by a use. When the user presses an upper surface 62 of the actuator 42, the actuator 42 heel slides along the arc surface 66. As shown is FIG. 7, the actuator 42 inclines left to the figure and the touching point 58 presses a corresponding switch 56 by passing through the opening 60 of the casing 38. Thus enabling the switch 56 to produce a sensing signal. After that time, a whole process of sensing is completed. A helical spring 46 clamped between the casing 38 and the base 54 provides a restoring elastic force to an origin equilibrium point for the actuator 42.

Compared to the prior input device 10, a fulcrum of the present invention input device 40 is equivalent to the center 70 as shown in FIG. 6. The distance between the fulcrum 70 of the present input device 40 and the upper surface 62 of the actuator 42 is shortened. Compared to a long distance between the fulcrum 24 of the prior input device 10 and the upper surface 32 of the actuator 12, the size of the present input device 40 is decreased.

Additionally, the actuator 12 and the elastic component 17 of the prior input device 10 are both set above the fulcrum, the user needs more displacement to actuate the actuator 12 and needs a lot of space to move the actuator 12. For remaining a movable space for the actuator 12, the input device 10 needs to be rigged around by a supporting wall 14. It increases the space required for the whole prior input device 10. Comparatively, the present input device 40 takes the actuator 42 as a fulcrum, the bar 50 and the helical spring suspended in midair are capable of swinging in a direction. It is convenient to actuate the present input device 40 for the user, and moreover, it effectively decreases space for movement of the actuator 42.

A supporting mechanism of the present input device 40 is provided by the helical spring 46, with the switch 56 provided by the touching point 58. The helical spring 46 is made of a metal so that a life of the helical spring 46 is longer than the elastic rubber material of the prior input device 10 naturally. Since the helical spring 46 is responsible for an elastic supporting mechanism of the present input device 40, the touching point 58 of the switch 56 needs not to be provided with elasticity and can be monolithically formed with stiff materials. The moving condition of the touching point 58 is guided by the corresponding opening 60 of the casing 38, so it is not important that the touching point 58 can not actuate the corresponding switch 56 exactly. Thus, it can be seen that the structure of the present input device 40 is firmer than the prior input device 10.

Figure 8:
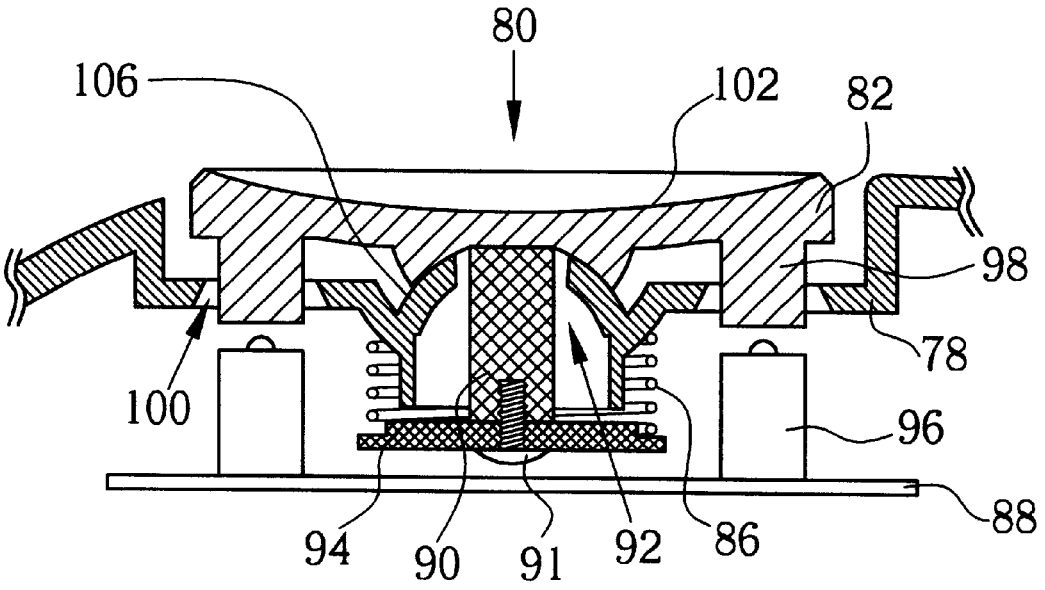
FIG. 8 is a section view of another preferred embodiment of the present invention input device.
Figure 9:
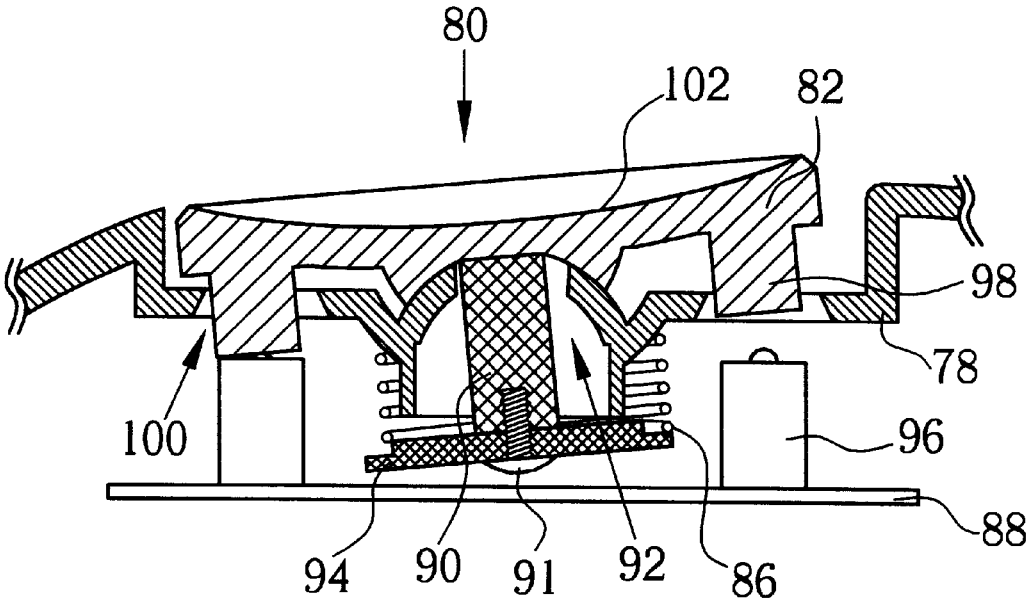
FIG. 9 is a diagram of the present invention input device depressed by a use as shown in FIG. 8.

Another preferred embodiment of the present input device 40 can be illustrated with FIG. 8. Please refer to FIG. 8 of a sectional view of another preferred embodiment of the present invention input device. The input device 80 is set on the casing 38, and the casing 78 comprises a supporting base 106 that is monolithically formed with the casing 78. The center of the supporting base 106 comprises an open hole 92 passing through the casing 78. The movable portion of the input device 80 is comprised of an actuator 82, a bar 90 and a base 94. The base 94 is fixed at a lower end of the bar 90 by a screw 91 so as to clamp a helical spring 86 between the open hole 92 and the base 94. A back plane 88 set fixedly within the casing 78 further comprises a switch 96. A touching point 98 of the actuator 82 passing through an opening 100 of the casing 78 is corresponding to the switch 96. The center of the actuator 82 bottom is an arc surface for exactly matching with the supporting base. Please refer to FIG. 9 of a diagram of the present invention input device depressed by a use as shown in FIG. 8. When a user presses an upper surface 102 of the actuator 82, the actuator 82 heels slidably along the arc surface of the supporting base. The touching point 98 presses a corresponding switch 96 by passing through the opening 100 of the casing 78. Thus enabling the switch 96 to produce a sensing signal.

Figure 10:
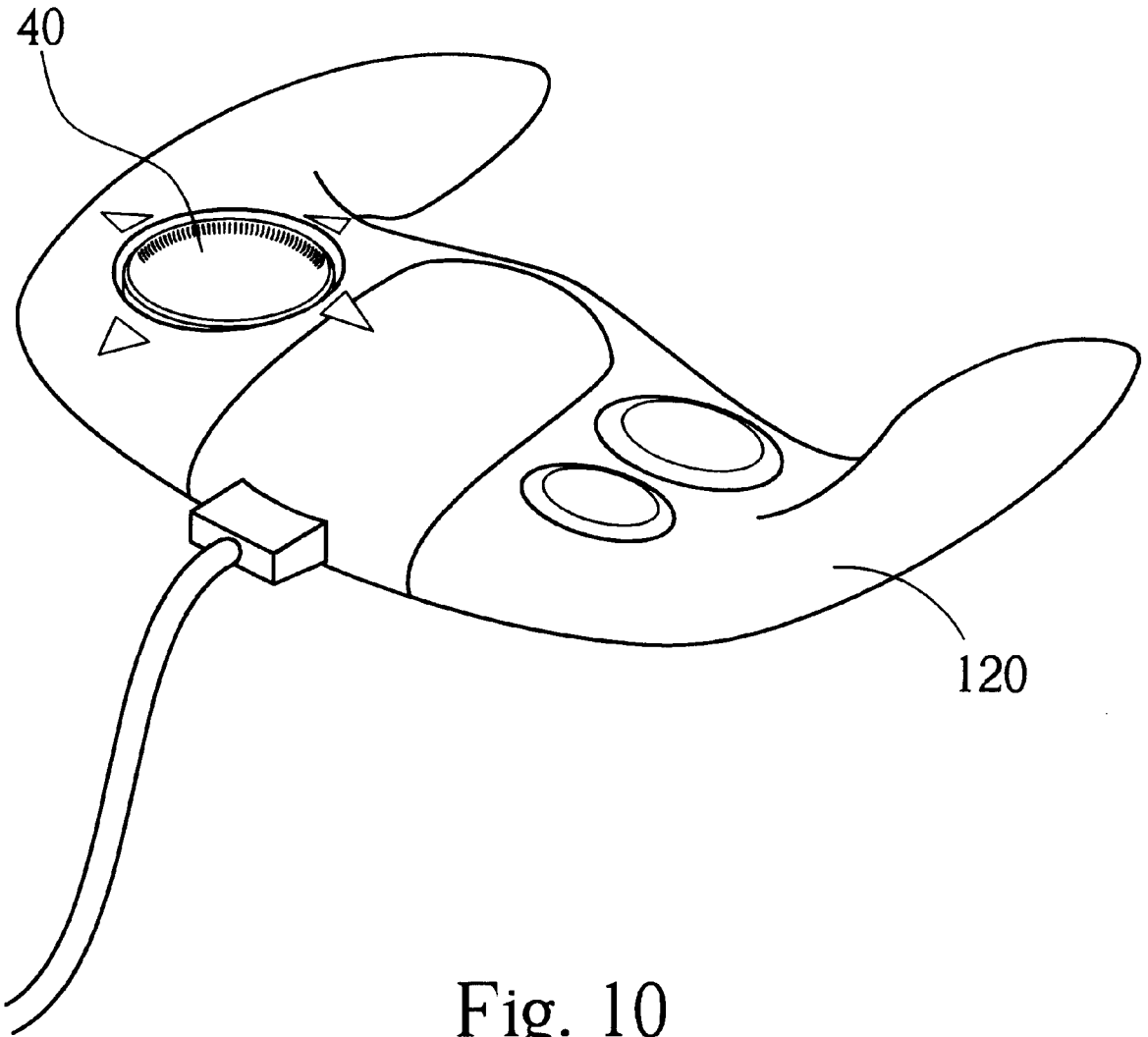
FIG. 10 is a diagram of the present invention input device used in a game pad.
Figure 11:
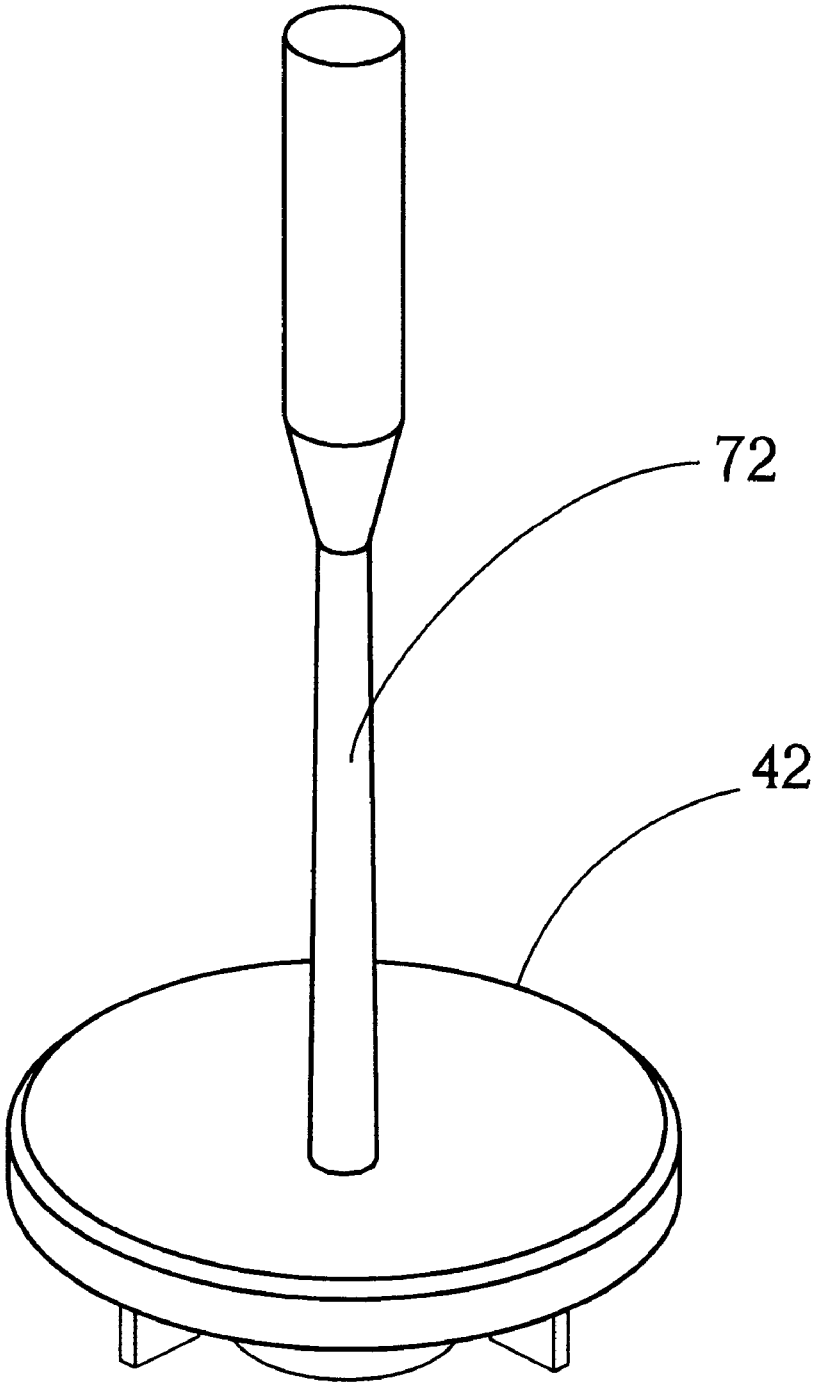
FIG. 11 is a diagram of another preferred embodiment of an actuator of the present invention input device.

Please refer to FIG. 10 of a diagram of the present invention input device 40 used in a game pad 120. The input device 40 above mentioned is used in a preferred embodiment of a mouse shape casing, but that does not mean the input device 40 is only used in a game pad. To match with the abilities of the game pad, the actuator 42 of the input device 40 can further dispose a joystick 72 as shown in FIG. 11 in order to enhance enjoyment in using the input device 40.

The above disclosure is not intended to be limiting. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An input device comprising:

a casing having at least an opening;

a supporting base set on the casing;

a base plate fixed to the casing and set within the casing;

at least a pressure sensor set on the base plate; and an actuator movably set on the supporting base;

wherein the actuator comprises at least a touching point set within the opening and above the pressure sensor, and when a user presses the actuator and moves the touching point downwards, the actuator pivots about a center of pivoting located at an upper surface of the actuator, and the touching point touches the pressure sensor to enable the pressure sensor to produce a corresponding sensing signal.

2. The input device of claim 1 wherein the supporting base is monolithically formed with the casing, the supporting base further comprising an open hole that passes through the casing, the actuator further comprising a bar, a top end of the bar set within the open hole of the supporting base and fixed at a bottom of the actuator; wherein when the actuator is depressed, the bar is capable of swinging toward a direction accompanied by the actuator.

3. The input device of claim 2 further comprising a base and an elastic component, the base fixed at a lower end of the bar, and the elastic component clamped between the base and an edge of the open hole.

4. The input device of claim 3 wherein the elastic component is a helical spring.

5. The input device of claim 3 wherein at least a screw is used to fix the base to the lower end of the bar.

6. The input device of claim 1 wherein the supporting base comprises a groove, and a bottom of the actuator is slidably disposed in the groove.

7. The input device of claim 1 further comprising a fixing pillar that is used to fix the base plate within the casing.

8. The input device of claim 1 wherein the pressure sensor is a switch.

9. The input device of claim 1 wherein the actuator comprises a joystick.

10. An input device comprising:

a casing having an open hole;

a base plate fixed to the casing and set within the casing;

at least a pressure sensor set on the base plate;

an actuator set in the open hole of the casing; and a bar with a top end set within the open hole of the casing and fixed at a bottom of the actuator, the bar capable of swinging in a direction;

wherein when a user presses the actuator and moves the actuator downwards, the actuator pivots about a center of pivoting located at an upper surface of the actuator, and the actuator touches the pressure sensor to enable the pressure sensor to produce a corresponding sensing signal.

11. The input device of claim 10 wherein the casing further comprises at least an opening and the actuator comprises at least a touching point set within the opening and above the pressure sensor, wherein when the user presses the actuator and moves the touching point downwards, the touching point touches the pressure sensor and enables the pressure sensor to produce a corresponding sensing signal.

12. The input device of claim 11 wherein the actuator comprises a joystick.

13. The input device of claim 10 wherein the pressure sensor is a switch.

* * * * *